US010526751B2

(12) United States Patent
Ogiwara

(10) Patent No.: US 10,526,751 B2
(45) Date of Patent: Jan. 7, 2020

(54) BASE FABRIC FOR A PAPERMAKING FELT HAVING SEAM LOOPS AND A METHOD OF PRODUCING THE SAME

(71) Applicant: Ichikawa Co., Ltd., Bunkyo-ku (JP)

(72) Inventor: Yasuyuki Ogiwara, Bunkyo-ku (JP)

(73) Assignee: Ichikawa Co., Ltd., Bunkyo-ku (JP)

( * ) Notice: Subject to any disclaimer, the term of this patent is extended or adjusted under 35 U.S.C. 154(b) by 363 days.

(21) Appl. No.: 15/407,421

(22) Filed: Jan. 17, 2017

(65) Prior Publication Data

US 2017/0204564 A1 Jul. 20, 2017

(30) Foreign Application Priority Data

Jan. 20, 2016 (JP) ..... 2016-008901

(51) Int. Cl.
*D21F 7/10* (2006.01)

(52) U.S. Cl.
CPC ..... *D21F 7/10* (2013.01); *D03D 2700/0162* (2013.01)

(58) Field of Classification Search
CPC ... D21F 7/08; D21F 7/083; D21F 7/10; D21F 7/12; D21F 1/10; D21F 1/105; D21F 1/12; D21F 1/14; D21F 1/16; D21F 1/0027; D21F 1/0036; D21F 1/0045; D21F 1/0054; D21F 1/0081; D03D 3/04; D03D 11/00; D03D 25/00; D03D 2700/0155; D03D 2700/0159; D03D 2700/0162
USPC ..... 162/348, 358.1, 358.2, 900, 902–904; 139/383 AA
See application file for complete search history.

(56) References Cited

U.S. PATENT DOCUMENTS 7,135,094 B2 * 11/2006 Watanabe ..... D21F 7/083 162/358.2
7,892,402 B2 * 2/2011 Hawes ..... D21F 1/0036 162/348

(Continued)

FOREIGN PATENT DOCUMENTS

JP 2004-512441 4/2004
JP 2010-540794 12/2010
WO WO 89/12717 * 12/1989 ..... D21F 7/08

(Continued)

*Primary Examiner* — Eric Hug
(74) *Attorney, Agent, or Firm* — Oblon, McClelland, Maier & Neustadt, L.L.P.

(57) ABSTRACT

The object is to provide a base fabric for a papermaking felt wherein there is no damage to the MD yarns of the seam loops and a method of producing the same.
This is achieved by a base fabric for a papermaking felt wherein seam loops are formed by MD yarns, which is made from MD yarns of the felt running direction (MD) and CD yarns of the felt cross-direction (CD); wherein the seam loops are obtained by removing CD yarns from a part other than the CD yarn no-removal part of a woven fabric comprising a seam loop region having the CD yarn no-removal part, and by moving CD yarns of the CD yarn no-removal part and CD yarns from between the CD yarn no-removal part and the part in which the CD yarns have been removed in the direction of the part in which the CD yarns have been removed, and wherein the strength of the MD yarns of the part in which the CD yarns have been removed is lower than the strength of the MD yarns of the CD yarn no-removal part.

5 Claims, 14 Drawing Sheets

(56) References Cited

U.S. PATENT DOCUMENTS

| | | | | |
|---|---|---|---|---|
| 8,043,477 | B2 * | 10/2011 | Crook | D21F 1/0036<br>139/383 AA |
| 8,353,252 | B1 * | 1/2013 | Klaschka | D21F 7/10<br>112/475.08 |

FOREIGN PATENT DOCUMENTS

| | | | |
|---|---|---|---|
| WO | WO 02/35000 | A1 | 5/2002 |
| WO | WO 2009/046017 | A1 | 4/2009 |

* cited by examiner (A)

(B)

(1)

(2)

(3)

BASE FABRIC FOR A PAPERMAKING FELT HAVING SEAM LOOPS AND A METHOD OF PRODUCING THE SAME

TECHNICAL FIELD

The present invention relates to a base fabric for a papermaking felt having seam loops and to a method of producing the same.

DESCRIPTION OF THE RELATED ART

Traditionally, the wet paper web is dewatered by a press felt and a pair of press rolls or by a press roll and a shoe press in the press part of a papermaking machine. As press felt, an open-ended felt having a seam loop as shown in FIG. 1 is known. In other words, the felt F is formed as an open-ended felt wherein a plurality of seam loops L are formed at each end. The felt F is, for example, formed by a base fabric B made of a woven fabric and two batt layers W, as shown in FIG. 2. The batt layer W is intertwiningly integrated together with the base fabric B by needle punching web fibers of short fibers layered on the base fabric B. The base fabric B is made of a woven fabric which is woven from yarns in the felt running direction (MD) of the felt and yarns in the cross-felt direction (CD) of the felt. The seam loops L are formed by the yarns of the felt running direction (MD).

When the felt is used, the open-ended felt F is installed in a papermaking machine, the two ends in the running direction (MD) of the felt are matched with each other, the seam loops of one end are fitted between the seam loops of the other end, and the seam loops of both ends are engaged with each other. When the seam loops are engaged, instead of directly matching them with each other from the front, the seam loops are engaged with each other after matching both ends in the form of a ridge as shown in FIG. 2(A). Consequently, when the seam loops of one end are fitted between the seam loops of the other end, the former seam loops are joined between the seam loops of the other end from the bottom to the top. Moreover, a dedicated jig is used for engaging the seam loops.

When the engaging operations are completed, a tunnel is formed by the holes of the continuous seam loops L, and a core wire S is inserted into the group of seam loop holes in the form of a tunnel, as shown in FIG. 2(B). Then, the endless felt F is formed in the papermaking machine by flattening the ends that were matched in the form of a ridge. This type of felt F is a so-called felt with seam loops (seam felt), which has come increasingly into use in recent years because its installation in papermaking machines is very good (for example Patent Document 1).

The felt F has a cross-felt direction (CD) width and the felt running direction (MD) length. When the felt F is formed from an open-ended shape into an endless shape, the outer circumferential surface of the felt is the surface contacting the wet paper web and the inner circumferential surface of the felt is the surface contacting the press roll. Moreover, the outer circumferential surface and the inner circumferential surface are both intertwiningly integrated with the base fabric by needle punching the batt layers W, and thus form the front and rear of the felt.

Next, the constitution of the base fabric B will be explained by referring to FIGS. 3 and 4. FIG. 3 is a schematic illustration of one end of the base fabric B. In FIG. 3, the base fabric B is formed by CD yarns 1 in the cross-felt direction (CD) and MD yarns 2 in the felt running direction (MD). FIG. 3 is a ⅓ warp double weave structure, and FIG. 4 is a ½ warp double weave structure. Moreover, it goes without saying, that the weave structures are not limited thereby and that any embodiment may be selected.

The MD yarns 2 form a pair of upper and lower yarns by folding the yarns back at the ends. In other words, in this case, the parallel MD yarns 2 form layers with each other, and the base fabric B is formed by the continuous yarn surfaces in each layer. Here, the portion of the MD yarn 2 protruding beyond the endmost portion of the CD yarn 1 forms the seam loops L at the folded back portion of the MD yarn 2.

The base fabric B is a fabric woven in endless shape, or it is made into an endless shape by joining both ends of an open-ended woven fabric.

In the following needle punching step, the base fabric B is completed as an endless felt by intertwiningly integrating the batt layers W forming the outer circumferential surface and the inner circumferential surface of the felt with the base fabric B. The seam felt can be used as an endless felt in a papermaking machine by once removing the core wire S, by transporting the open-ended felt to the papermaking machine and by inserting the core wire S again into the seam loops in the papermaking machine.

Methods of forming seam loops according to the prior art include, for example, a method of forming seam loops at a predetermined position of the base fabric B when weaving an endless shape by hollow weaving, and a method of forming seam loops at a predetermined position of a base fabric B after weaving an endless or open-ended woven fabric.

According to Patent Documents 2 and 3, methods of forming seam loops at a predetermined position of fabric B after weaving are known in which the CD yarns of the portion forming the seam loops of the woven fabric are removed. Moreover, according to Patent Document 4, a method is known in which a skipper or a special filler yarn is used as the CD yarn which is removed from the portion forming the seam loops.

PRIOR ART DOCUMENTS

Patent Documents

Patent Document 1: PCT/JP-A-2004-512441
Patent Document 2: WO-A-89/12717
Patent Document 3: U.S. Pat. No. 8,353,252
Patent Document 4: PCT/JP-2010-540794

SUMMARY OF THE INVENTION

Problems to be Solved by the Invention

However, when removing the CD yarns of the portion forming the seam loops (seam loop region) of the woven fabric after weaving as in Patent Documents 2 to 4, there is the problem of damage to the MD yarns of the seam loop region, such as the occurrence of scratches to the MD yarns of the seam loop region due to the means of removal, or the dissolution of the MD yarns due to the friction between the MD yarns of the seam loop region and the CD yarns to be removed. Damage to the MD yarns of the seam loop region is not only a cause for the reduction of base fabric or felt production yield, but there is also the fear that the service life of the felt will be reduced due to the breakage of seam loops when the core wire is inserted or when the felt is used.

Consequently, the object of the present invention is to provide a base fabric for a papermaking felt wherein there is no damage to the MD yarns of the seam loops or wherein there is no damage that will reduce the seam loop strength and a method of producing the same.

Means for Solving the Problems of the Invention

The present inventors, as a result of intensive studies in order to achieve the above object, found that by removing CD yarns from a part other than the part in which the strength of the seam loops is reduced when MD yarns of the seam loop region formed by the seam loops in a woven fabric are damaged (hereinafter referred to as "CD yarn no-removal part"), and by moving CD yarns of the CD yarn no-removal part and CD yarns from between the CD yarn no-removal part and the part in which the CD yarns have been removed in the direction of the part in which the CD yarns have been removed, it is possible to form seam loops wherein there is no damage to the MD yarns or wherein there is no damage that will reduce the strength of the seam loops.

In other words, the present invention relates to the following.

(1) A base fabric for a papermaking felt wherein seam loops are formed by MD yarns, which is made from MD yarns of the felt running direction (MD) and CD yarns of the felt cross-direction (CD); wherein the seam loops are obtained by removing CD yarns from a part other than the CD yarn no-removal part of a woven fabric comprising a seam loop region having the CD yarn no-removal part, and by moving CD yarns of the CD yarn no-removal part and CD yarns from between the CD yarn no-removal part and the part in which the CD yarns have been removed in the direction of the part in which the CD yarns have been removed, and wherein the strength of the MD yarns of the part in which the CD yarns have been removed is lower than the strength of the MD yarns of the CD yarn no-removal part.

(2) A base fabric according to (1); wherein the length of the CD yarn no-removal part in the felt running direction (MD) is 10 to 100% of the seam loop region in the felt running direction (MD).

(3) A base fabric according to (1) or (2); wherein the CD yarn no-removal part comprises a part that is to become the top part of the seam loops, and wherein the CD yarn removal part is provided so that the end part of the side of the part that is to become the seam loop top part is situated 5% or more of the length of the seam loop region in the felt running direction (MD) from the part that is to become the seam loop top part.

(4) A base fabric for a papermaking felt formed by joining together two or more of the base fabric according to (1) in the cross-felt direction (CD).

(5) A base fabric according to (4); wherein the width dimension in the cross-felt direction (CD) of the base fabric according to (1) is 50 cm to 1000 cm.

(6) A base fabric for a papermaking felt formed by providing an additional base fabric either on the front side or on the rear side of the base fabric according to (4).

(7) A method of producing a base fabric for a papermaking felt wherein seam loops are formed by MD yarns, which is made from MD yarns and CD yarns; wherein are comprised a step for weaving a woven fabric from MD yarns and CD yarns, wherein is comprised a seam loop region having a CD yarn no-removal part;

a step for removing CD yarns from a part other than the CD yarn no-removal part; and a step for forming seam loops by moving CD yarns of the CD yarn no-removal part and CD yarns from between the CD yarn no-removal part and the part in which the CD yarns have been removed in the direction of the part in which the CD yarns have been removed.

(8) A method of production according to (7); wherein the length of the CD yarn no-removal part in the felt running direction (MD) is 10 to 100% of the length of the seam loop region in the felt running direction (MD).

(9) A method of production according to (7) or (8); wherein the CD yarn no-removal part comprises a part that is to become the top part of the seam loops, and wherein the CD yarn removal part is provided so that the end part of the side of the part that is to become the seam loop top part is situated 5% or more of the length of the seam loop region in the felt running direction (MD) from the part that is to become the seam loop top part.

(10) A method of production according to any one of (7) to (9); wherein, in the step for weaving a woven fabric, a different type of yarn is used for the CD yarns of the CD yarn removal part than for the CD yarns constituting the base fabric for a papermaking felt.

(11) A method of production according to any one of (7) to (10); wherein the step for removing CD yarns comprises a step for cutting the CD yarns to be removed at predetermined intervals.

Advantages of the Invention

By the above constitution it is possible to provide a base fabric for a papermaking felt wherein there is no damage to the MD yarns of the seam loop region or wherein there is no damage that will reduce the seam loop strength and a method of producing the same.

BEST MODES FOR CARRYING OUT THE INVENTION

Figure 1:
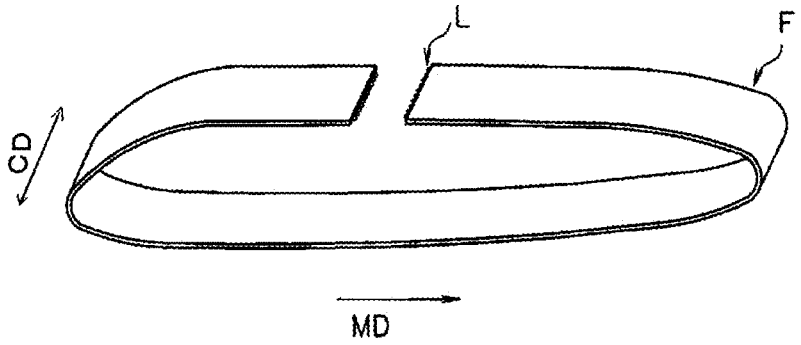
FIG. 1 is a schematic view of a prior art seam felt for papermaking.
Figure 2:
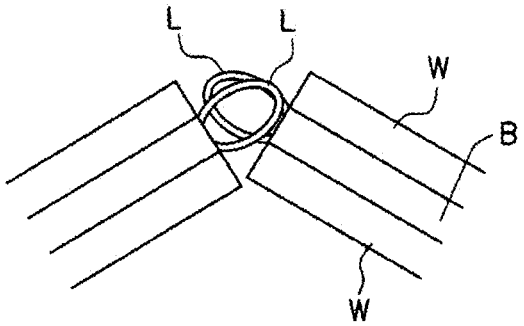
FIG. 2 shows the engaging operations of a prior art seam felt for papermaking.
Figure 2:
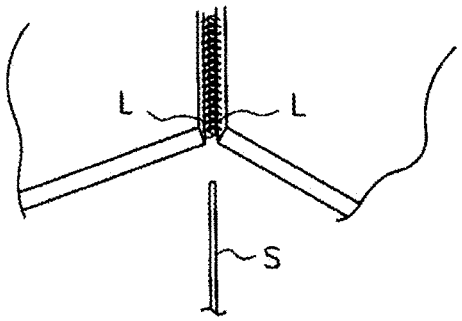
Figure 3:
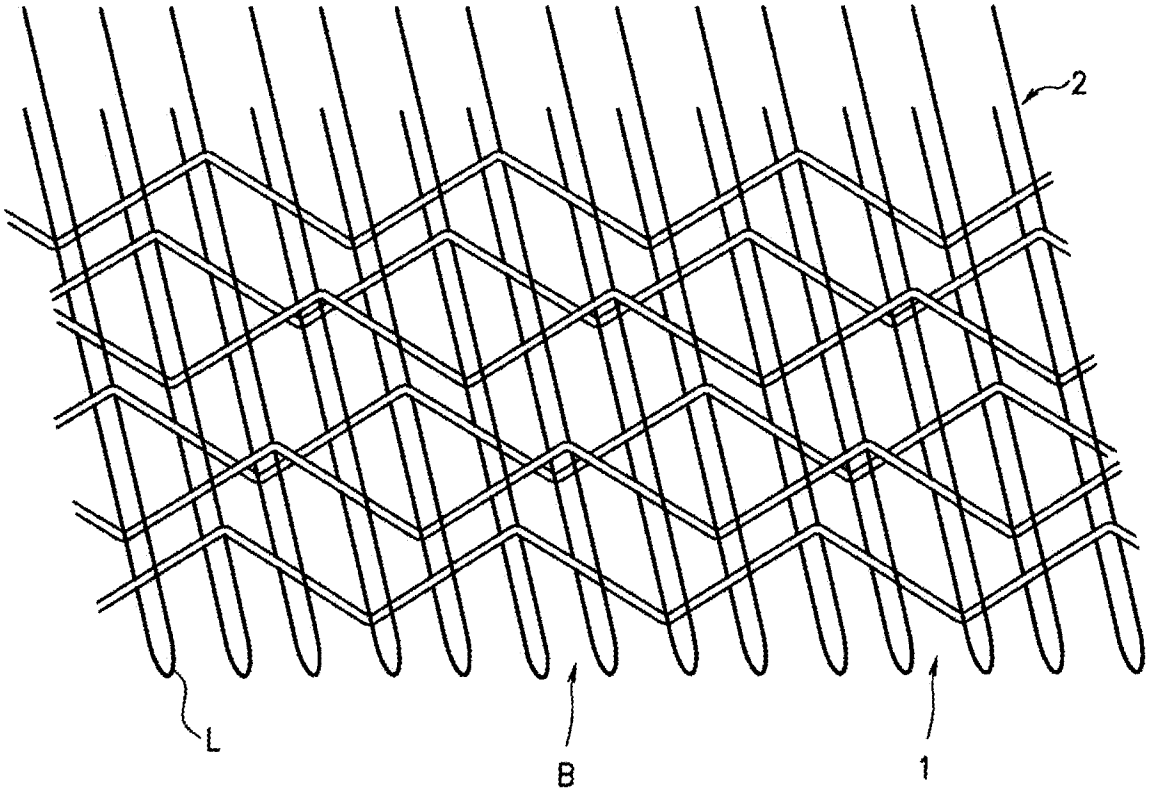
FIG. 3 is a schematic view showing the base fabric end of a prior art seam felt for papermaking.
Figure 4:
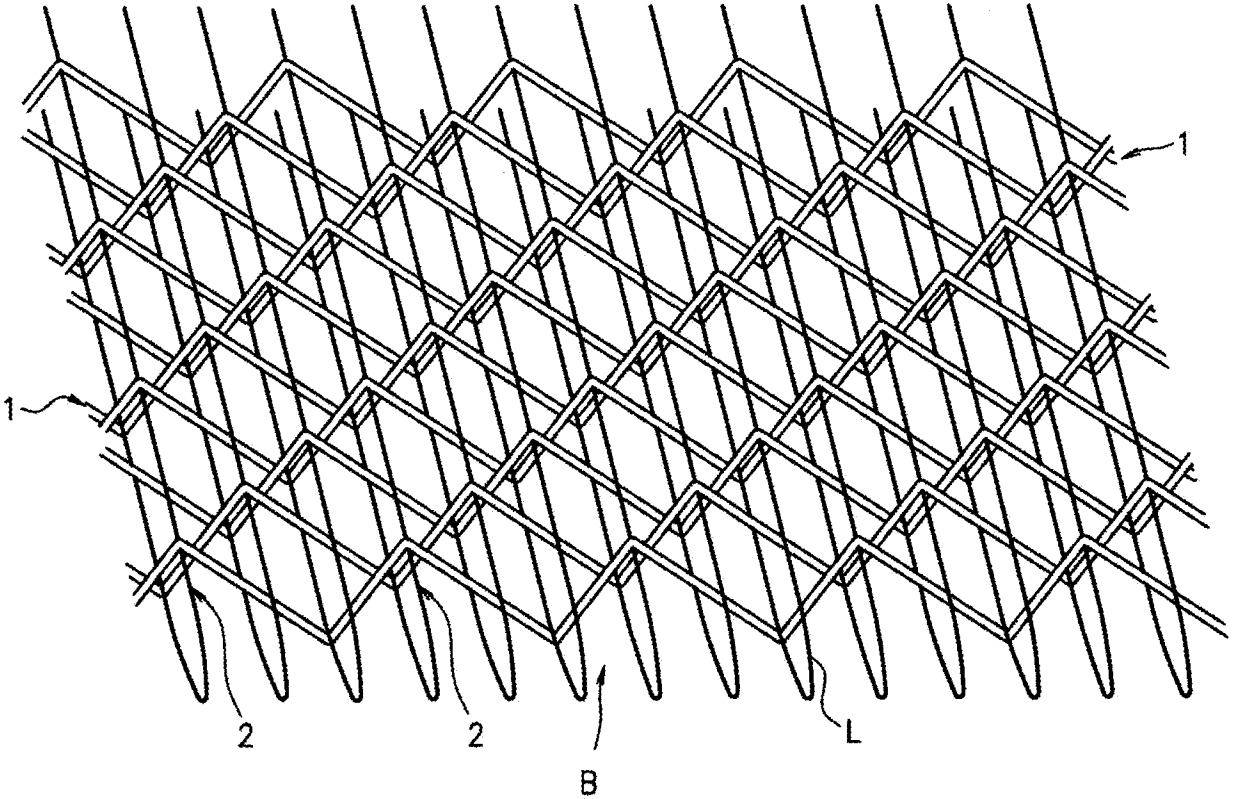
FIG. 4 is a schematic view showing the base fabric end of a prior art seam felt for papermaking.

Hereinafter, embodiments of a base fabric for a papermaking felt having seam loops according to the present invention and a method of producing the same will be explained while referring to the drawings; however, the present invention is not limited thereto.

Moreover, unless otherwise defined in the present specification, the technical and scientific terms used in the present specification have the meaning commonly understood by a person skilled in the art. All patents, applications and other publications referred to in the present specification, including information available from the Internet, are hereby incorporated by reference in their entirety into the present specification.

Figure 5:
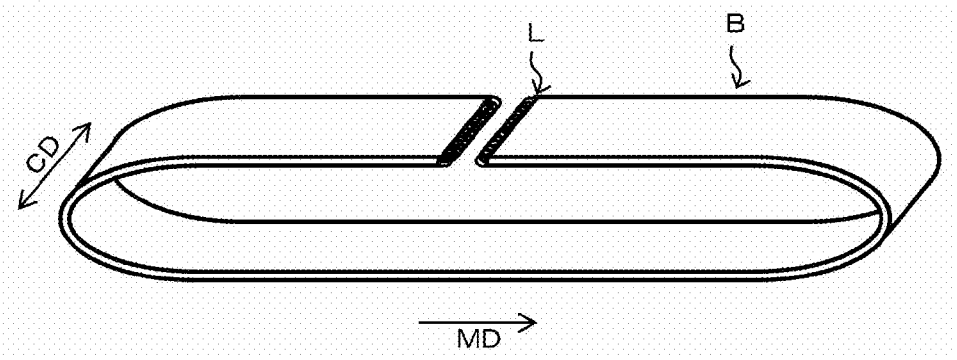
FIG. 5 is a schematic view of a base fabric for a papermaking felt according to the present invention.
Figure 6:
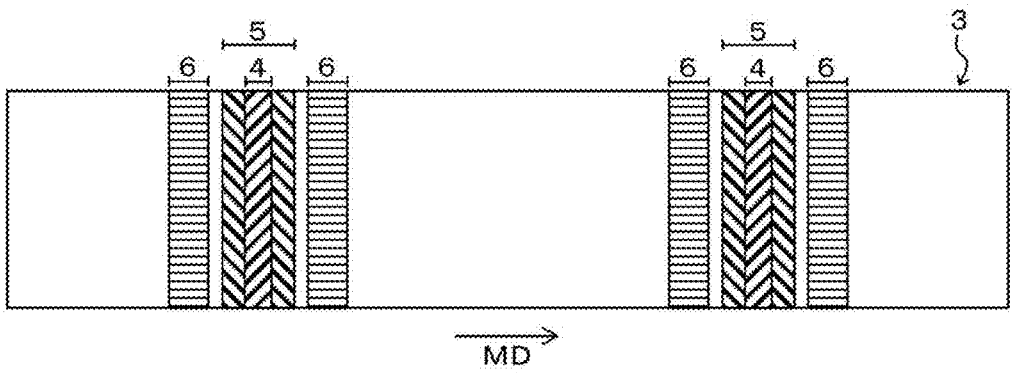
FIG. 6 is a schematic view of a woven fabric constituting a base fabric for a papermaking felt according to the present invention.

A base fabric B for a papermaking felt according to the present invention, as shown in FIG. 5, comprises MD yarns of the felt running direction (MD) and CD yarns of the cross-felt direction (CD). Seam loops L are formed by the MD yarns. The seam loops L are obtained by removing CD yarns from a part other than the CD yarn no-removal part 4 of a woven fabric comprising a seam loop region 5 having the CD yarn no-removal part 4 shown in FIG. 6, and by moving CD yarns of the CD yarn no-removal part 4 and CD yarns from between the CD yarn no-removal part 4 and the part in which the CD yarns have been removed in the direction of the part in which the CD yarns have been removed. The strength of the MD yarns of the part in which the CD yarns have been removed is lower than the strength of the MD yarns of the CD yarn no-removal part 4.

The difference between the strength of the MD yarns of the part in which the CD yarns have been removed and the strength of the MD yarns in the CD yarn no-removal part 4 is not particularly limited as long as the former is lower than the latter and the same quality is guaranteed in the parts of the papermaking felt comprising the part in which the CD yarns have been removed as in the parts of the papermaking felt comprising other regions; the difference can for example be 30 to 99%, or more specifically 30 to 80%.

In the present invention, firstly a woven fabric to be used as base fabric for a papermaking felt is produced.

The woven fabric may be produced by weaving an endless shape by hollow weaving, or it may be produced by joining together both ends of an open-ended shape to form an endless shape.

Examples of weave patterns of the woven fabric include plain weave, twill weave and satin weave; plain weave is preferred. The spacing between the MD yarns is not particularly limited; however, 30 to 65 yarns/5 cm is preferred and 40 to 55 yarns/5 cm is even more preferred. The spacing between the CD yarns is not particularly limited; however, 30 to 65 yarns/5 cm is preferred and 40 to 55 yarns/5 cm is even more preferred.

The weave pattern of the seam loop region 5, the CD yarn removal part 6 and other regions may be the same or may be different.

The seam loop regions 5 are provided at positions corresponding to both ends of the base fabric in the woven fabric when the base fabric for a papermaking felt is formed from a woven fabric. The length of the seam loop region 5 in the MD direction is determined by the diameter of the core wire inserted later. Examples of core wire include, for example, a monofilament of a diameter of 1.28 mm and a bundle of 4 monofilaments of a diameter of 0.35 mm each.

Figure 7:
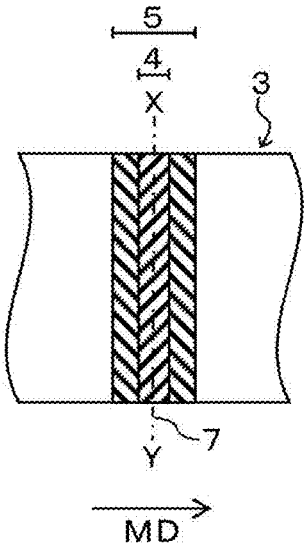
FIG. 7 is a schematic view showing the constitution of the seam loop region of a woven fabric constituting a base fabric for a papermaking felt according to the present invention.

As shown in FIG. 7, the seam loop region 5 comprises the CD yarn no-removal part 4. Moreover, the CD yarn no-removal part 4 comprises a part 7 that is to become the top part of the seam loops. In the present invention, the part 7 that is to become the seam loop top part comprises the apex of each MD yarn when both ends of the seam loop region 5 are folded together in the felt running direction (MD). This part is a predetermined part positioned at equidistance from both ends of the seam loop region 5 in the felt running direction (MD). In the present invention, the CD yarn no-removal part 4 is the part within the seam loop region 5 in which the seam loop strength is adversely affected (the seam loop strength is reduced) when the MD yarns of the seam loop region 5 forming the seam loops are damaged, for example, in case CD yarns are cut and pulled out from the seam loop region 5, and when damage to the MD yarns occurs due to this removal. The length of the CD yarn no-removal part 4 in the felt running direction (MD) may be equal to or shorter than the length of the seam loop region 5 in the felt running direction (MD); for example, it may be 10 to 100%, or preferably 50 to 100%, of the number of CD yarns of the seam loop region.

The CD yarn removal part 6 may be provided on one side of the CD yarn no-removal part 4 of each seam loop region 5 or it may be provided on both sides in the felt running direction (MD). It is possible to provide one or more CD yarn removal part(s) 6 for each seam loop region 5. Both in case the CD yarn removal part 6 is provided on one side of each of the CD yarn no-removal parts 4 in the felt running direction (MD) and in case it is provided on both sides, one region for each side is preferred. From the point of view that, after removing CD yarns from the CD yarn removal part 6, CD yarns of the CD yarn no-removal part 4 and CD yarns from between the CD yarn no-removal part 4 and the part in which the CD yarns have been removed are moved in the direction of the part in which the CD yarns have been removed, it is preferred to repeatedly remove continuous multiple units of CD yarns for each region at a time. For example, in case the weave pattern of the woven fabric is a plain weave, it is preferred to remove an even number of continuous CD yarns for each region.

From the point of view of avoiding damage to the MD yarns of the CD yarn no-removal part 4 due to the removal of CD yarns from the CD yarn no-removal part 4, the CD yarn removal part 6 is not particularly limited as long as it does not comprise the CD yarn no-removal part 4. The CD yarn removal part 6 and the CD yarn no-removal part 4 may be adjacent or may be distant from each other.

Preferably, the CD yarn removal part 6 is provided at a length of 5% or more in the felt running direction (MD) of the seam loop region 5 from the part 7 that is to become the seam loop top part at the end of the side that is to become the seam loop top part, more preferable it is 5 to 100%, even more preferable it is 25 to 80% and most preferable it is 50 to 75%. From the point of view of the efficiency with which CD yarns of the CD yarn no-removal part 4 and CD yarns from between the CD yarn no-removal part 4 and the part in which the CD yarns have been removed are moved in the direction of the part in which the CD yarns have been removed, it is preferred that the CD yarn removal part 6 is 25 to 80% and even more preferred 50 to 75%.

Figure 8:
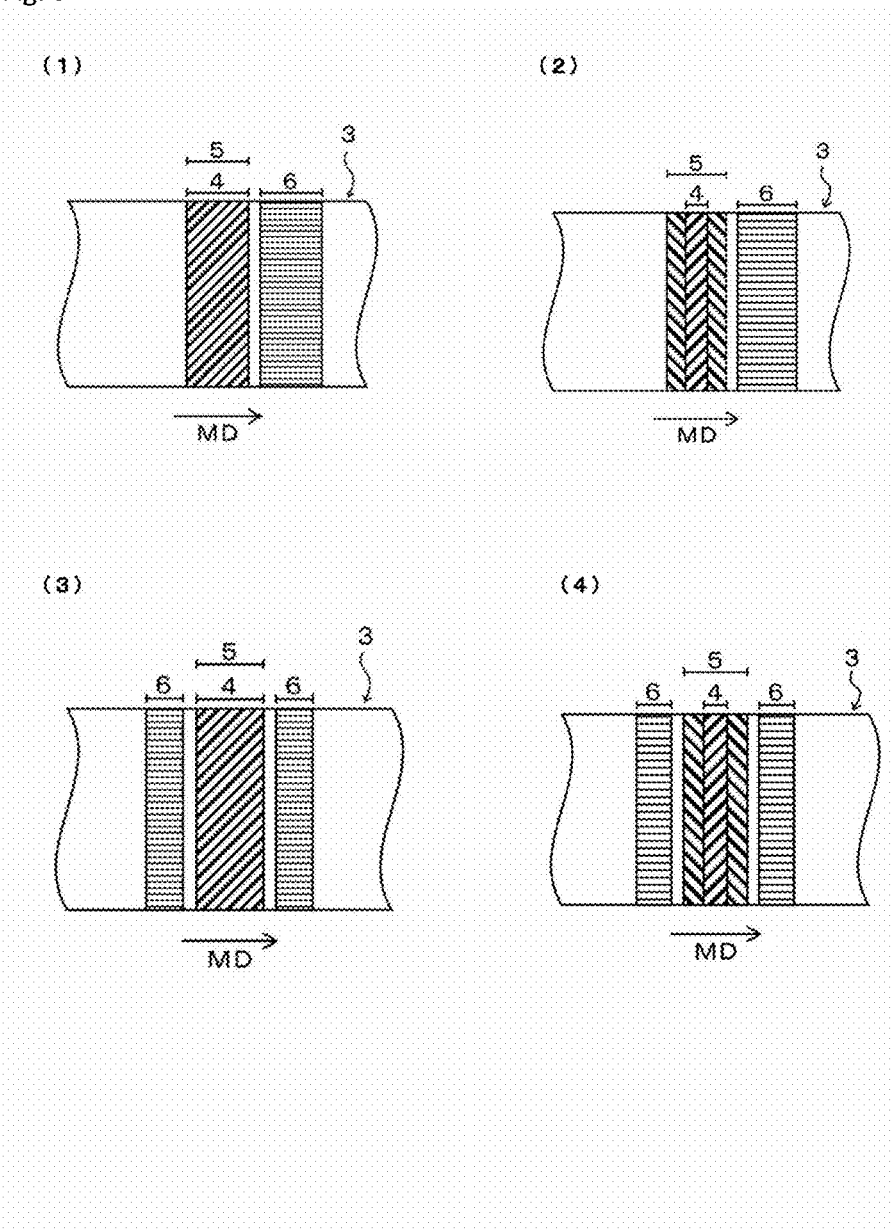
FIG. 8 is a view showing embodiments of the positional relationship of the CD yarn no-removal part, the CD yarn removal part and the seam loop region in a woven fabric constituting a base fabric for a papermaking felt according to the present invention.

In one embodiment, the length of the CD yarn no-removal part 4 in the felt running direction (MD) is equal to the length of the seam loop region 5 in the felt running direction (MD), and the CD yarn removal part 6 is provided on one side of the seam loop region 5 so as not to adjoin the seam loop region 5 (FIG. 8(1)).

In one embodiment, the length of the CD yarn no-removal part 4 in the felt running direction (MD) is shorter than the length of the seam loop region 5 in the felt running direction (MD), and the CD yarn removal part 6 is provided on one side of the seam loop region 5 so as not to adjoin the seam loop region 5 (FIG. 8(2)).

In one embodiment, the length of the CD yarn no-removal part 4 in the felt running direction (MD) is equal to the length of the seam loop region 5 in the felt running direction (MD), and the CD yarn removal part 6 is provided on both sides of the seam loop region 5 so as not to adjoin the seam loop region 5 (FIG. 8(3)).

In one embodiment, the length of the CD yarn no-removal part 4 in the felt running direction (MD) is shorter than the length of the seam loop region 5 in the felt running direction (MD), and the CD yarn removal part 6 is provided on both sides of the seam loop region 5 so as not to adjoin the seam loop region 5 (FIG. 8(4)).

Figure 9:
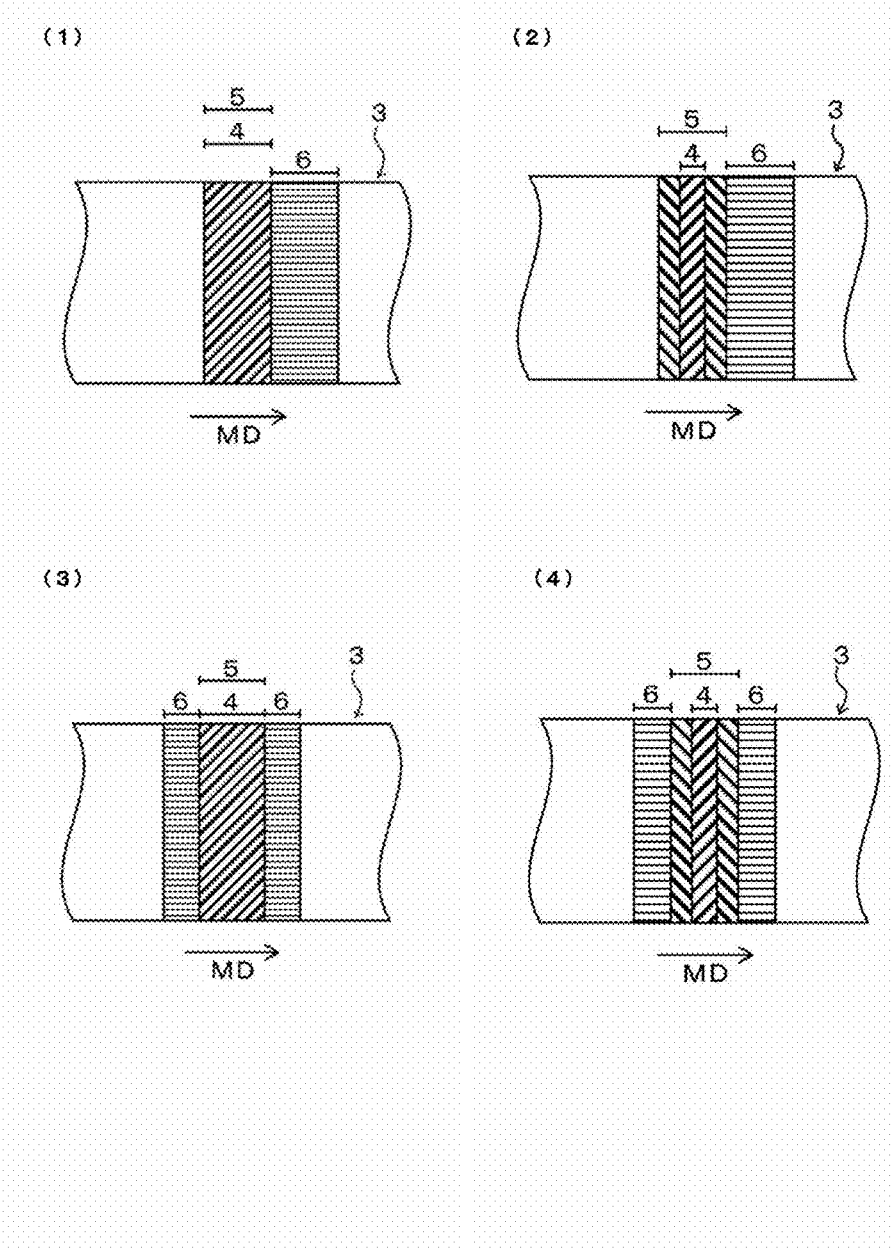
FIG. 9 is a view showing embodiments of the positional relationship of the CD yarn no-removal part, the CD yarn removal part and the seam loop region in a woven fabric constituting a base fabric for a papermaking felt according to the present invention.

In one embodiment, the length of the CD yarn no-removal part 4 in the felt running direction (MD) is equal to the length of the seam loop region 5 in the felt running direction (MD), and the CD yarn removal part 6 is provided on one side of the seam loop region 5 so as to adjoin the seam loop region 5 (FIG. 9(1)).

In one embodiment, the length of the CD yarn no-removal part 4 in the felt running direction (MD) is shorter than the length of the seam loop region 5 in the felt running direction (MD), and the CD yarn removal part 6 is provided on one side of the seam loop region 5 so as to adjoin the seam loop region 5 (FIG. 9(2)).

In one embodiment, the length of the CD yarn no-removal part 4 in the felt running direction (MD) is equal to the length of the seam loop region 5 in the felt running direction (MD), and the CD yarn removal part 6 is provided on both sides of the seam loop region 5 so as to adjoin the seam loop region 5 (FIG. 9(3)).

In one embodiment, the length of the CD yarn no-removal part 4 in the felt running direction (MD) is shorter than the length of the seam loop region 5 in the felt running direction (MD), and the CD yarn removal part 6 is provided on both sides of the seam loop region 5 so as to adjoin the seam loop region 5 (FIG. 9(4)).

Figure 10:
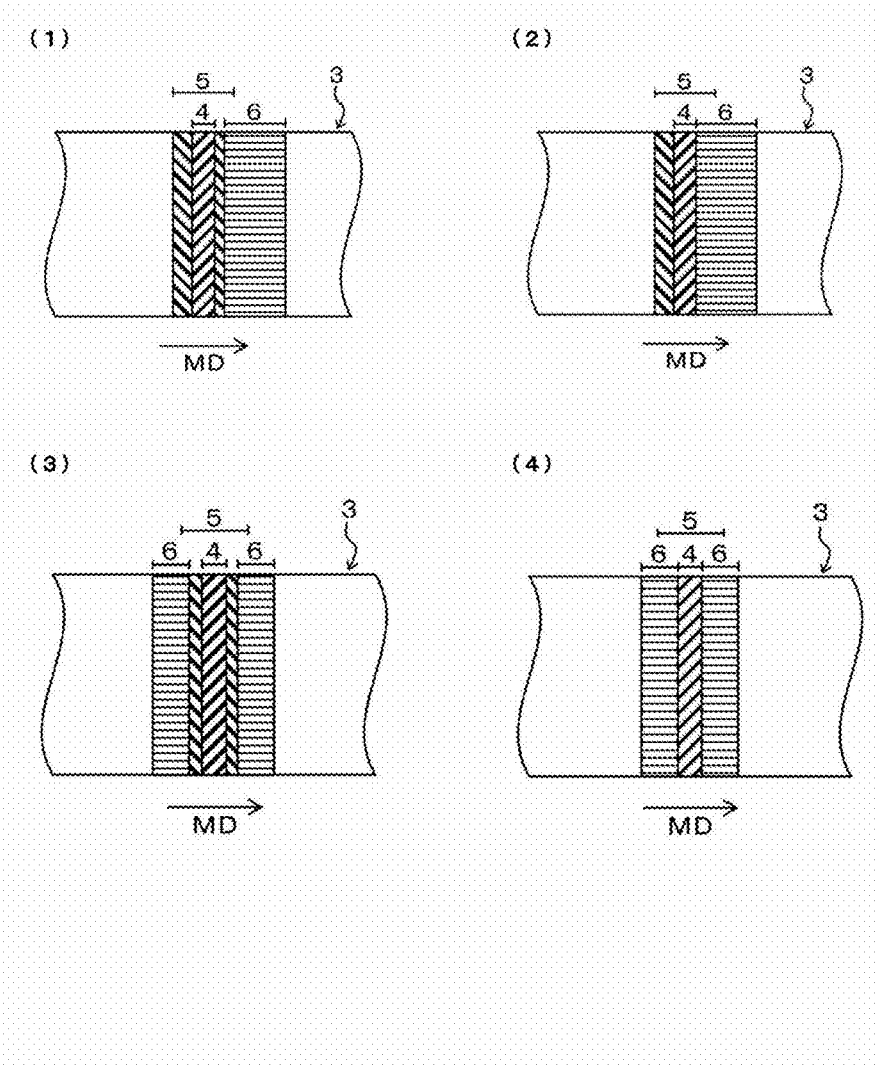
FIG. 10 is a view showing one embodiment of the positional relationship of the CD yarn no-removal part, the CD yarn removal part and the seam loop region in a woven fabric constituting a base fabric for a papermaking felt according to the present invention.

In one embodiment, the length of the CD yarn no-removal part 4 in the felt running direction (MD) is shorter than the length of the seam loop region 5 in the felt running direction (MD), and the CD yarn removal part 6 is provided on one side of the CD yarn no-removal part 4 so as not to adjoin the CD yarn no-removal part 4 and to partially overlap the seam loop region 5 (FIG. 10(1)).

In one embodiment, the length of the CD yarn no-removal part 4 in the felt running direction (MD) is shorter than the length of the seam loop region 5 in the felt running direction (MD), and the CD yarn removal part 6 is provided on one side of the CD yarn no-removal part 4 so as to adjoin the CD yarn no-removal part 4 and to partially overlap the seam loop region 5 (FIG. 10(2)).

In one embodiment, the length of the CD yarn no-removal part 4 in the felt running direction (MD) is shorter than the length of the seam loop region 5 in the felt running direction (MD), and the CD yarn removal part 6 is provided on both sides of the CD yarn no-removal part 4 so as not to adjoin the CD yarn no-removal part 4 and to partially overlap the seam loop region 5 (FIG. 10(3)).

In one embodiment, the length of the CD yarn no-removal part 4 in the felt running direction (MD) is shorter than the length of the seam loop region 5 in the felt running direction (MD), and the CD yarn removal part 6 is provided on both sides of the CD yarn no-removal part 4 so as to adjoin the CD yarn no-removal part 4 and to partially overlap the seam loop region 5 (FIG. 10(4)).

The length of each seam loop region 5 in the felt running direction (MD) is the total length of one or more CD yarn removal part(s) 6 provided on one side or on both sides of the seam loop region 5 in the felt running direction (MD). The length of each CD yarn removal part 6 in the felt running direction (MD) is not particularly limited as long as this condition is fulfilled.

As material of the MD yarns and CD yarns, general purpose materials employed in base fabrics for papermaking felts may be used. They may be appropriately selected from fiber materials such as nylon, polyester, polypropylene, natural materials, and the like. The material of the MD yarns and CD yarns may be identical or different.

The material of the CD yarns of the seam loop region 5, the CD yarns to be removed and the CD yarns of other regions may be identical or different. For the purpose of increasing the distinguishability of the CD yarns to be removed, it is also possible to use a different material only for the CD yarns to be removed or to use the same material with a different colour. Moreover, it is possible to use a material that is easy to remove for the CD yarns to be removed. Apart from the CD yarns mentioned above, it is possible to use, for example, a water soluble fiber for the CD yarns to be removed.

The spacing of the CD yarns of the seam loop region 5, the CD yarns to be removed and the CD yarns in other regions may be identical or different.

The woven fabric is next subjected to the step for removing CD yarns from the CD yarn removal part 6.

The means for removing CD yarns from the CD yarn removal part 6 are not particularly limited; however, the CD yarns to be removed may for example be cut at predetermined intervals of, for example, 3 to 30 cm, and the cut CD yarns may be pulled out. The means for pulling the yarns out are not particularly limited; however, the yarns can be removed by a gripping tool having a taper or a tip that is suitable for gripping an object (CD yarns) from a woven fabric such as radio pliers, pliers, and the like. When water soluble fibers are used as CD yarns to be removed, the CD yarns are removed by dissolving them in water.

Next, a step is provided for forming the seam loops by moving CD yarns of the CD yarn no-removal part 4 and CD yarns from between the CD yarn no-removal part 4 and the part in which the CD yarns have been removed in the direction of the part in which the CD yarns have been removed.

The means for forming the seam loops by moving CD yarns of the CD yarn no-removal part 4 and CD yarns from between the CD yarn no-removal part 4 and the part in which the CD yarns have been removed in the direction of the part in which the CD yarns have been removed are not particularly limited; however, the CD yarns may for example be moved one by one from the CD yarn close to the part in which the CD yarns have been removed by a tool having a taper such as a serration or a tip for entering the gaps of the tissue formed by the MD yarns and CD yarns FIGS. 11 to 14 illustrate the displacement of CD yarns in the step for forming the seam loops by moving CD yarns of the CD yarn no-removal part 4 and CD yarns from between the CD yarn no-removal part 4 and a part in which the CD yarns have been removed 6' in the direction of the part in which the CD yarns have been removed 6'. In FIGS. 11 to 14, (A) shows the state before the CD yarns are removed, (B) shows the state in which the CD yarns have been removed, and (C) shows the state in which the CD yarns in the seam loop region 5 have disappeared by being moved.

Figure 11:
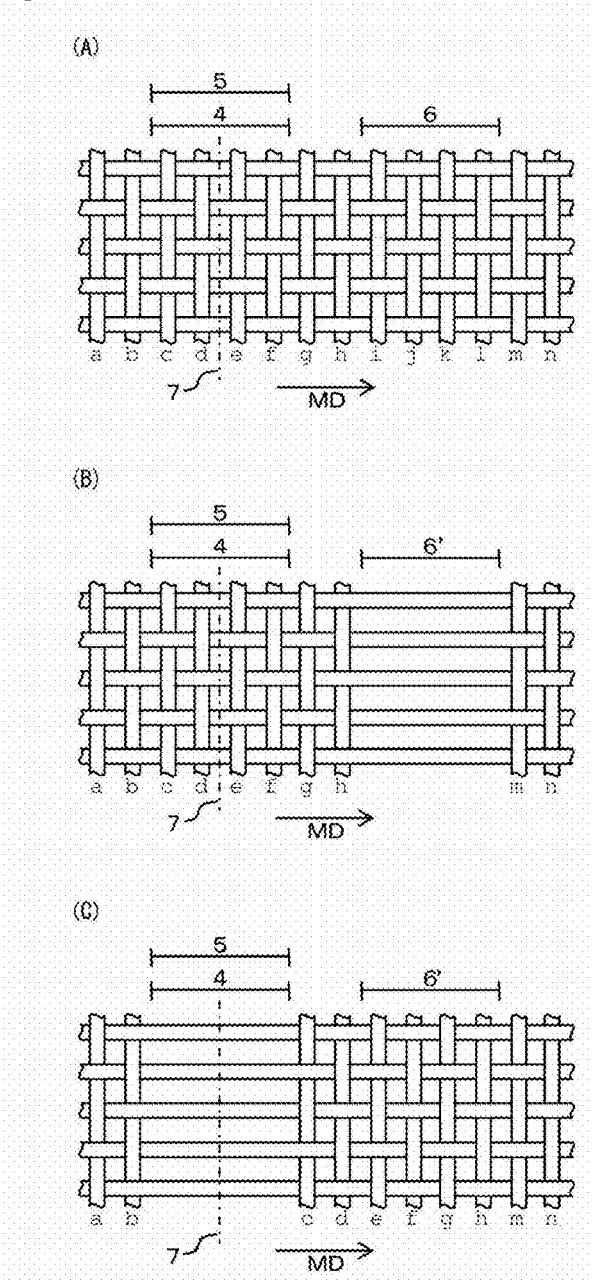
FIG. 11 is a view showing one embodiment of a method of producing a base fabric for a papermaking felt according to the present invention.

FIG. 11 shows an embodiment in which the length of the CD yarn no-removal part 4 in the felt running direction (MD) is equal to the length of the seam loop region 5 in the felt running direction (MD), and the CD yarn removal part 6 is provided so as not to adjoin the seam loop region 5. Seam loops are formed by removing CD yarns i to l from the CD yarn removal part 6, and by moving CD yarns c to f of the CD yarn no-removal part 4 and CD yarns g to h from between the CD yarn no-removal part 4 and the part in which the CD yarns have been removed 6' in the direction of the part in which the CD yarns have been removed 6'.

Figure 12:
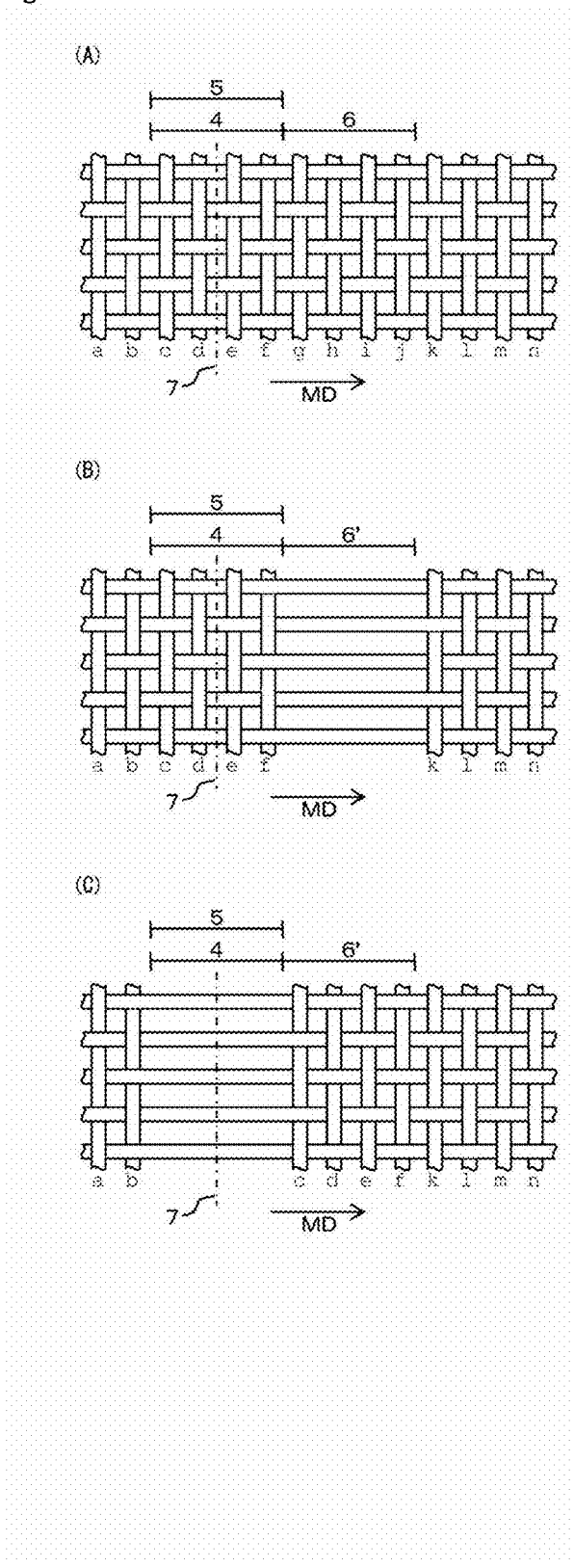
FIG. 12 is a view showing one embodiment of a method of producing a base fabric for a papermaking felt according to the present invention.

FIG. 12 shows an embodiment in which the length of the CD yarn no-removal part 4 in the felt running direction (MD) is equal to the length of the seam loop region 5 in the felt running direction (MD), and the CD yarn removal part 6 is provided so as to adjoin the seam loop region 5. Seam loops are formed by removing CD yarns g to j from the CD yarn removal part, and by moving CD yarns c to f of the seam loop region 5 in the direction of the part in which the CD yarns have been removed 6'.

Figure 13:
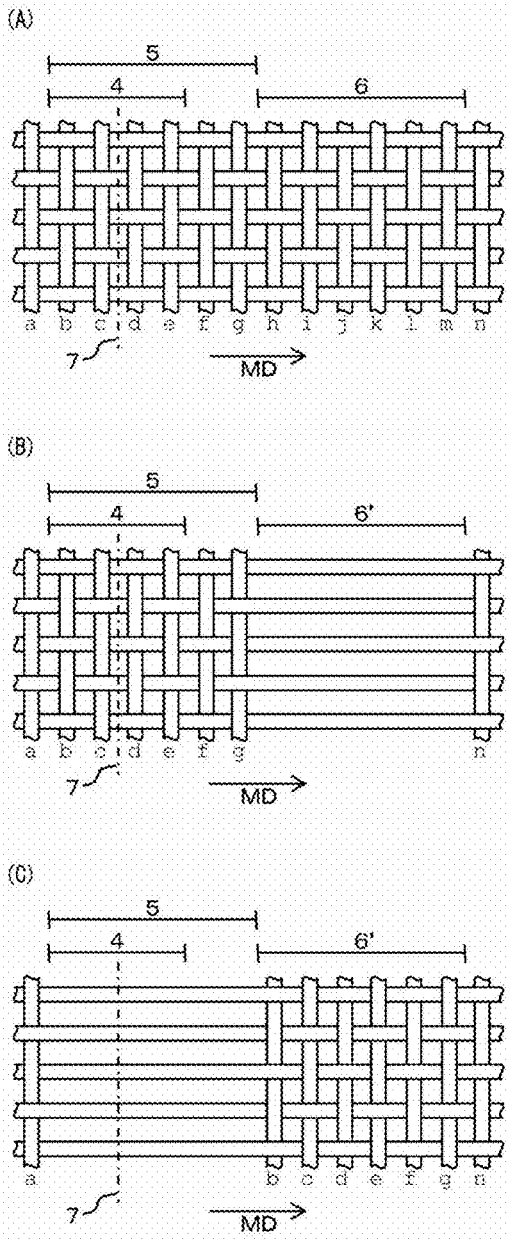
FIG. 13 is a view showing one embodiment of a method of producing a base fabric for a papermaking felt according to the present invention.

FIG. 13 shows an embodiment in which the length of the CD yarn no-removal part 4 in the felt running direction (MD) is shorter than the length of the seam loop region 5 in the felt running direction (MD), and the CD yarn removal part 6 is provided so as not to adjoin the CD yarn no-removal part 4, while adjoining the seam loop region 5. Seam loops are formed by removing CD yarns h to m from the CD yarn removal part, and by moving CD yarns b to g of the seam loop region 5 in the direction of the part in which the CD yarns have been removed 6'.

Figure 14:
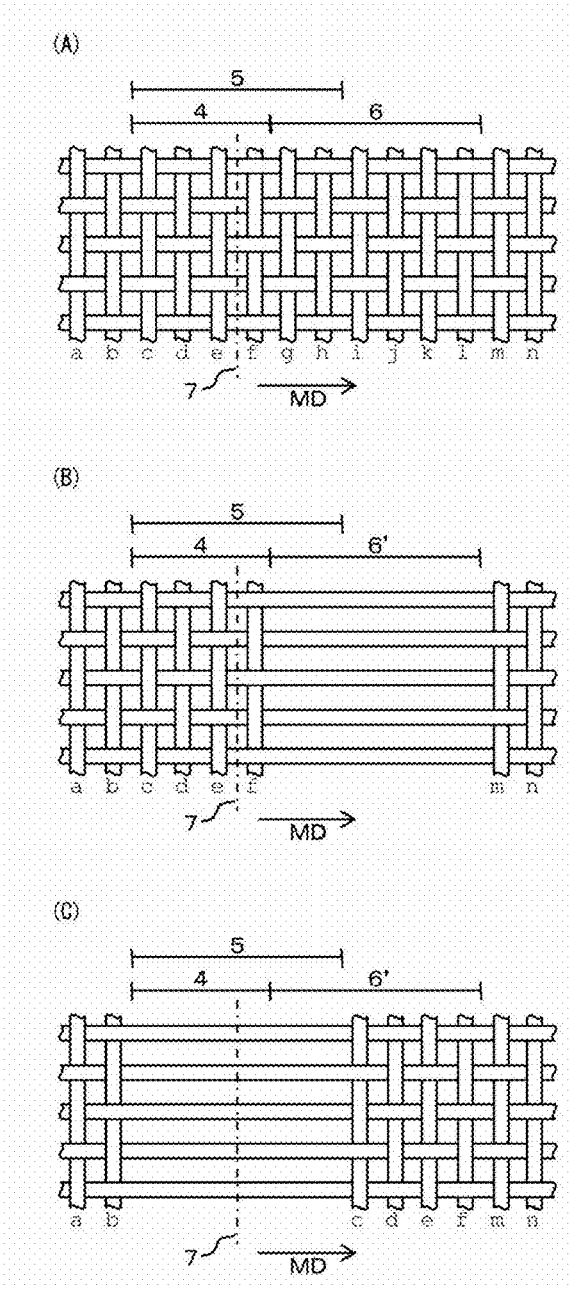
FIG. 14 is a view showing one embodiment of a method of producing a base fabric for a papermaking felt according to the present invention.

FIG. 14 shows an embodiment in which the length of the CD yarn no-removal part 4 in the felt running direction (MD) is shorter than the length of the seam loop region 5 in the felt running direction (MD), and the CD yarn removal part 6 is provided so as to adjoin the CD yarn no-removal part 4 and to partially overlap the seam loop region 5. Seam loops are formed by removing CD yarns g to l from the CD yarn removal part, and by moving CD yarns c to f of the seam loop region 5 which were not removed in the direction of the part in which the CD yarns have been removed 6'.

The base fabric for a papermaking felt according to the present invention may be used as a single base fabric or it may be used by joining together 2 or more base fabrics in the cross-felt direction (CD).

In case 2 or more base fabrics produced by using an open-ended woven fabric are joined together in the cross-felt direction (CD), it is preferred that the parts joining together both ends of the open-ended woven fabric are not aligned in a line. For this purpose, the seam loop region 5 in each of the open-ended woven fabrics is provided so as not to have the same arrangement.

The means for the joining together in the cross-felt direction (CD) are not particularly limited; however, such means as sewing by sewing machine, bonding, welding, and the like, can for example be mentioned.

The width dimension in the cross-felt direction (CD) of each of the base fabrics to be joined together is not particularly limited; however, it is determined according to the specification, the weaving efficiency, and the like, of the weaving machine producing the woven fabric, for example, in the range from 50 to 1,000 cm.

The number of based fabrics to be joined together and the width dimension in the cross-felt direction (CD) of each base fabric are determined according to the width dimension in the cross-felt direction (CD) of the papermaking felt to be produced in the end.

Moreover, in case the base fabric for a papermaking felt according to the present invention is a base fabric in which 2 or more base fabrics have been joined together in the cross-felt direction (CD), it is preferred to further provide an additional base fabric at least on one side of either the front side or the rear side of this base fabric for the purpose of securing strength and for preventing the occurrence of marks of the joining part on the web paper web.

The additional base fabric is not particularly limited; however, as long the strength can be secured and the occurrence of marks of the joining part on the web paper web can be prevented, it can, for example, be freely selected from woven fabrics, nonwoven fabrics, strands of yarn, grid-shaped materials, and the like.

EXAMPLES

Hereinafter, a base fabric for a papermaking felt according to the present invention will by explained in even greater detail by the example; however, the present invention is not limited by this example.

The woven fabrics of Example 1 and Comparative Example 1 of 1 m width in the cross-felt direction (CD), 20 m length in the felt running direction (MD), MD yarn spacing of 50 yarns/5 cm and CD yarn spacing of 50 yarns/5 cm were produced by using the MD yarns and the CD yarns shown below. In Example 1, the CD yarns to be removed are used in the CD yarn removal part 6 shown below. In Comparative Example 1, the CD yarns to be removed are used in the seam loop region 5.

MD yarn: polyamide 6 with 0.40 mm fiber diameter

CD yarn to be removed: polyamide 6 with 0.40 mm fiber diameter

CD yarn of parts other than the CD yarn removal part 6: polyamide 6 with 0.40 mm fiber diameter

Example 1

Figure 15:
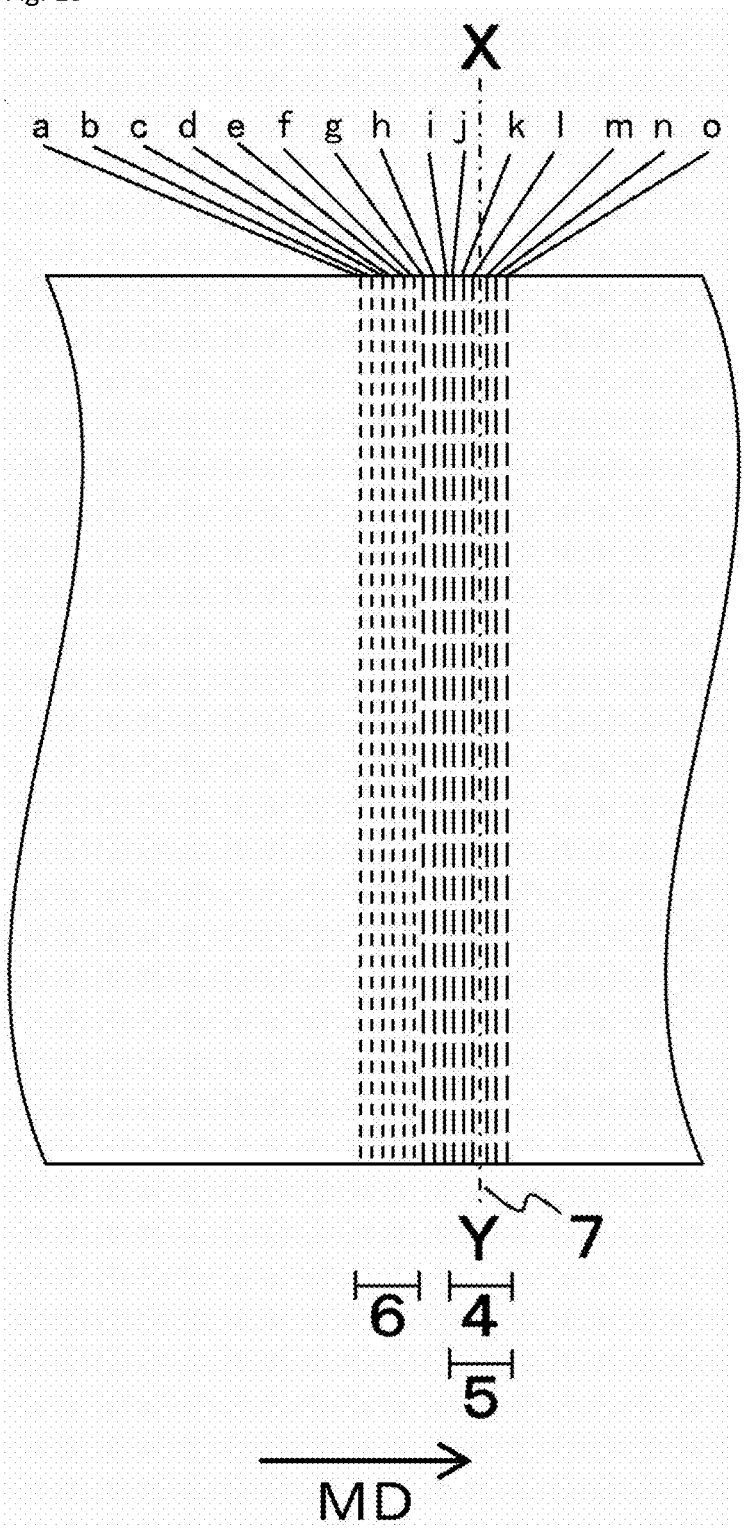
FIG. 15 is a view showing the woven fabric of Example 1.

In order to form seam loops of 6 mm length, as shown in FIG. 15, a base fabric was provided with a total of 6 CD yarns to be removed (a to f) in the CD yarn removal part 6, a total of 6 CD yarns (j to o) in the seam loop region 5 which is the CD yarn no-removal part 4, and a total of 3 CD yarns (g to i) between the CD yarn removal part 6 and the seam loop region 5; wherein the CD yarns to be removed were cut at 20 cm intervals, and the cut CD yarns were removed by pulling the ends of each of the cut CD yarns with radio pliers from the same side (X side). The seam loops were formed by moving the CD yarns g to o in the direction of the part in which the CD yarns have been removed.

Comparative Example 1

Figure 16:
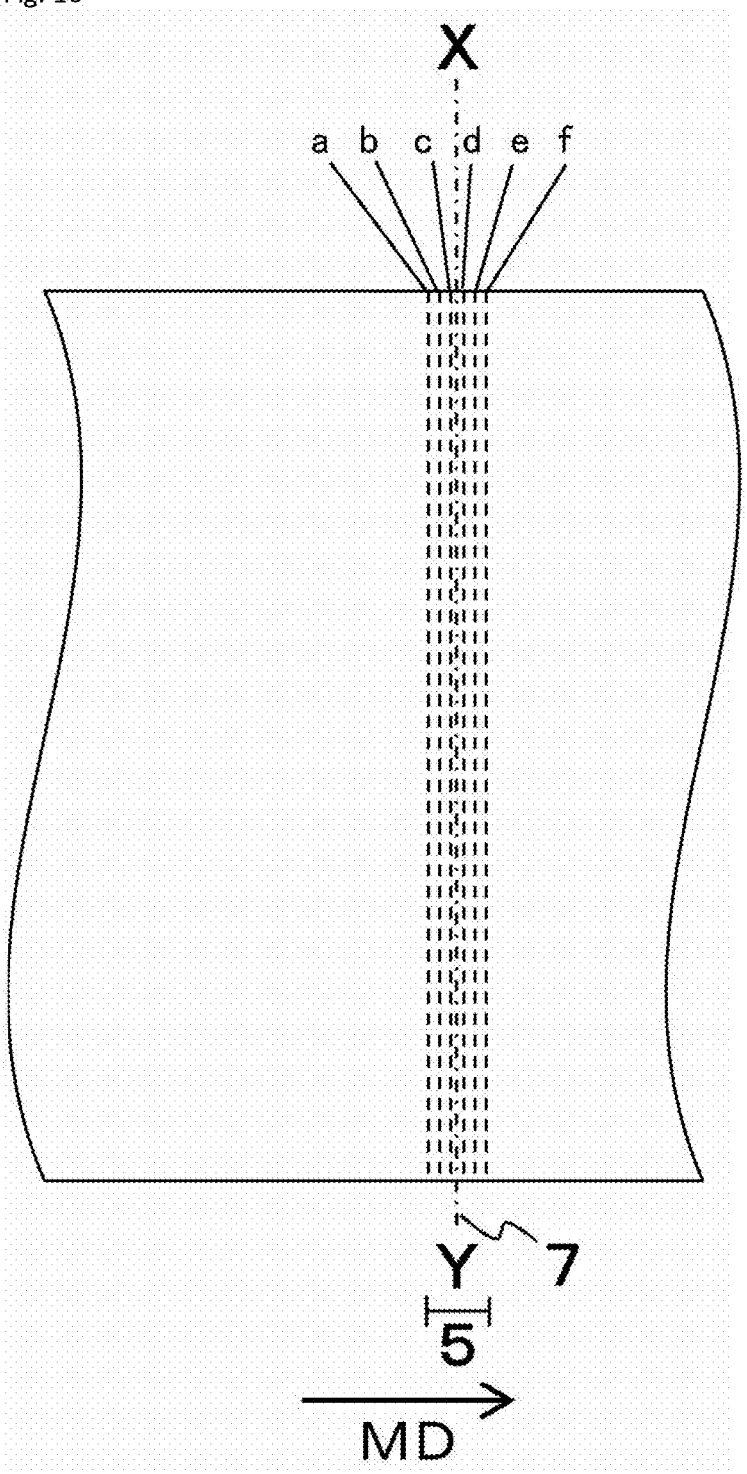
FIG. 16 is a view showing the woven fabric of Comparative Example 1.

In order to form seam loops of 6 mm length, as shown in FIG. 16, a total of 6 CD yarns (a to f) constituting the seam loop region 5 were cut at 20 cm intervals, and the cut CD yarns were removed by pulling the ends of each of the cut CD yarns with radio pliers from the same side (X side).

Rupture Strength Test

The cutting strength of the samples produced for Example 1 and Comparative Example 1 were measured. One of the MD yarns constituting the seam loops formed by moving CD yarns on the extension line of each end part vicinity of the side (X side) from which the CD yarns cut in Example 1 were pulled out, one of the MD yarns constituting the seam loops of each end part vicinity of the side (X side) from which the CD yarns cut in Comparative Example 1 were pulled out, and one of MD yarns constituting the seam loops of each end part vicinity of the opposite side (Y side) of the side from which the cut CD yarns were pulled out, were respectively selected. A load was applied to the selected MD yarns and the load at the point at which rupture occurred was recorded. The results are shown in Table 1.

TABLE 1

Unit: kgf/1 yarn

| | Example | Comparative Example | |
|---|---|---|---|
| | X side | X side | Y side |
| 1 | 4.340 | 3.480 | 5.816 |
| 2 | 7.941 | 2.588 | 6.727 |
| 3 | 8.731 | 2.224 | 6.889 |
| 4 | 6.686 | 2.208 | 6.596 |
| 5 | 6.883 | 3.266 | 7.431 |
| average | 6.916 | 2.753 | 6.692 |

While the average load recorded for the MD yarns constituting the seam loops formed by moving CD yarns on the extension line in the felt running direction (MD) of each end part vicinity of the side (X side) from which the CD yarns cut in Example 1 were pulled out was 6.916 kgf, the average load recorded for the MD yarns constituting the seam loops of each end part vicinity of the side (X side) from which the CD yarns cut in Comparative Example 1 were pulled out was 2.753 kgf. When comparing Example 1 to Comparative Example 1, the strength declined to about 40%. It is thought that the reason for this is that the MD yarns constituting the seam loops of each end part vicinity of the side (X side) from which the CD yarns cut in Comparative Example 1 were pulled out were damaged when the CD yarns were cut, and that the MD yarns dissolved at the side at which the CD yarns were pulled out as a result of the frictional heat that occurred when the CD yarns were pulled out at the side (X side) from which the cut CD yarns were pulled out. Compared to this, in Example 1, the MD yarns constituting the seam loops maintained the original strength of the MD yarns used for weaving because there is no risk that the MD yarns constituting the seam loops are damaged when the CD yarns are cut or that they dissolve when the CD yarns are pulled out.

Figure 17:
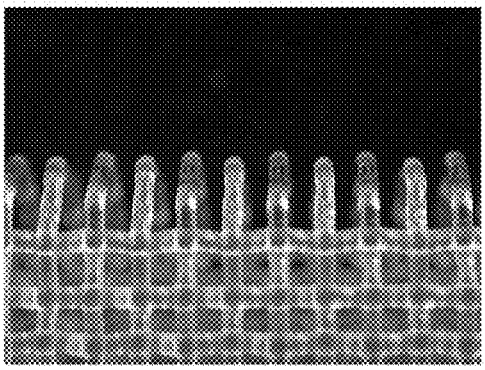
FIG. 17 is (1) a photograph of the MD yarns constituting the seam loops formed by moving CD yarns on the extension line in the felt running direction (MD) of the end part vicinity of the side (X side) from which the CD yarns cut in Example 1 were pulled out, (2) a photograph of the MD yarns constituting the seam loops of each end part vicinity of the side (X side) from which the CD yarns cut in Comparative Example 1 were pulled out, and (3) a photograph of MD yarns constituting the seam loops near the ends at the opposite side (Y side) of the side from which the CD yarns cut in Comparative Example 1 were pulled out.
Figure 17:
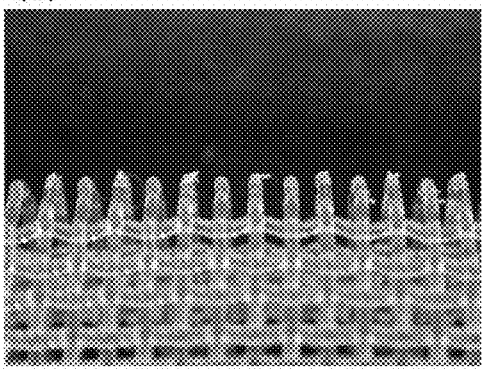
Figure 17:
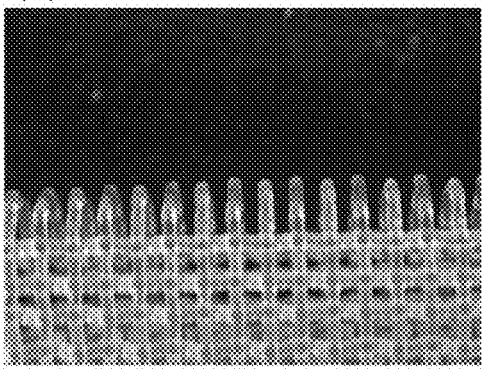

A photograph of the MD yarns constituting the seam loops formed by moving CD yarns on the extension line in the felt running direction (MD) of the end part vicinity of the side (X side) from which the CD yarns cut in Example 1 were pulled out is shown in FIG. 17(1). A photograph of the MD yarns constituting the seam loops of each end part vicinity of the side (X side) from which the CD yarns cut in Comparative Example 1 were pulled out is shown in FIG. 17(2), and a photograph of MD yarns constituting the seam loops near the ends at the opposite side (V side) of the side from which the cut CD yarns were pulled out is shown in FIG. 17(3).

As shown in FIG. 17(1), damage to the MD yarns of the CD yarn no-removal part 4 was not detected in the base fabric for a papermaking felt of Example 1. On the other hand, while there was minor damage to the MD yarns constituting the seam loops in the end part vicinity of the opposite side (Y side) of the side from which the cut CD yarns were pulled out in the base fabric for a papermaking felt of Comparative Example 1, as shown in FIG. 17(3), damage to the MD yarns of the seam loop region 5 was detected in the end part vicinity of the side (X side) from which the cut CD yarns were pulled out, as shown in FIG. 17(2). In the end part vicinity of the opposite side (Y side) of the side from which the cut CD yarns were pulled out of end parts other than those shown in FIG. 17(3), the same degree of damage was observed as in the MD yarns constituting the seam loops in FIG. 17(3); and in the end part vicinity of the side (X side) from which the cut CD yarns were pulled out of end parts other than those shown in FIG. 17(2), the same degree of damage was observed as in the MD yarns of the seam loop region 5 shown in FIG. 17(2).

The various features of the invention according to the present specification can be combined in different ways. The embodiments obtained by these combinations, including the combinations which are not specifically described in the present specification, are all within the scope of the present invention. Moreover, a person skilled in the art understands that a plurality of variations is possible without departing from the spirit of the present invention, and the equivalents including these variations are also included in the scope of the present invention. It is therefore to be understood that the embodiments described herein are only illustrative and are not intended to limit the scope of the present invention.

EXPLANATION OF THE REFERENCE CHARACTERS

F Felt
L Seam loops
B Base fabric
W Batt layer
S Core wire
1 CD yarn
2 MD yarn
3 Woven fabric
4 CD yarn no-removal part
5 Seam loop region
6 CD yarn removal part
6' Part in which the CD yarns have been removed
7 Part that is to become the seam loop top part

The invention claimed is:

1. A method of producing a base fabric for a papermaking felt which is made from MD yarns and CD yarns, wherein seam loops are formed by MD yarns, and wherein the method comprises:

weaving a woven fabric from MD yarns and CD yarns, wherein the woven fabric comprises a seam loop region having a CD yarn no-removal part;

removing CD yarns from a part other than the CD yarn no-removal part; and forming seam loops by moving CD yarns of the CD yarn no-removal part and CD yarns from between the CD yarn no-removal part and the part in which the CD yarns have been removed in the direction of the part in which the CD yarns have been removed.

2. A method of producing a base fabric for a papermaking felt according to claim 1, wherein the length of the CD yarn no-removal part in the felt running direction (MD) is 10 to 100% of the length of the seam loop region in the felt running direction (MD).

3. A method of producing a base fabric for a papermaking felt according to claim 1, wherein the CD yarn no-removal part comprises a part that is to become the top part of the seam loops, and wherein the CD yarn removal part is provided so that an end of the side of the part that is to become the seam loop top part is situated 5% or more of the length of the seam loop region in the felt running direction (MD) from the part that is to become the seam loop top part.

4. A method of producing a base fabric for a papermaking felt according to claim 1, wherein, during the weaving a woven fabric, a different type of yarn is used for the CD yarns of the CD yarn removal part than for the CD yarns constituting the base fabric for a papermaking felt.

5. A method of producing a base fabric for a papermaking felt according to claim 1, wherein the removing CD yarns further comprises cutting the CD yarns to be removed at predetermined intervals.

* * * * *